United States Patent [19]

Sterner, Jr.

[11] Patent Number: 4,683,676

[45] Date of Patent: Aug. 4, 1987

[54] TILT WINDOW BALANCE SHOE ASSEMBLY

[75] Inventor: Maurice E. Sterner, Jr., Spring Grove, Pa.

[73] Assignee: Product Design & Development, Inc., York, Pa.

[21] Appl. No.: 799,826

[22] Filed: Nov. 20, 1985

[51] Int. Cl.[4] ..... E05D 15/22

[52] U.S. Cl. ..... 49/181; 49/453; 49/176

[58] Field of Search ..... 49/172, 173, 176, 181, 49/453

[56] References Cited

U.S. PATENT DOCUMENTS

| | | | |
|---|---|---|---|
| 616,484 | 12/1898 | Myers | 49/181 |
| 3,055,062 | 9/1962 | Peters et al. | 49/181 |
| 3,091,005 | 5/1963 | Woodhams | 49/176 |
| 3,184,784 | 5/1965 | Peters | 49/181 |
| 3,399,490 | 9/1968 | Heitinger | 49/176 |
| 3,434,236 | 3/1969 | Weidner et al. | 49/181 |
| 3,959,926 | 6/1976 | Noecker et al. | 49/181 |

*Primary Examiner*—Kenneth J. Dorner
*Assistant Examiner*—Gerald A. Anderson
*Attorney, Agent, or Firm*—Samuel M. Learned, Jr.

[57] ABSTRACT

A tilt window balance shoe assembly embodying a split balance shoe structure which enables the replaceable installation and removal thereof within a window casing jamb channel thereby eliminating either the window casing production prefabrication and cost therefor of providing a specially cut window jamb notch to accommodate the after-installation removal of a worn and reinstallation of a conventional unitarily constructed replacement tilt window balance shoe, or, if no such access notch has been provided, then elimination of both the maintenance and repair cost and inconvenience of additionally removing and reinstalling the window sash counterbalance mechanism in order to otherwise accomplish conventional balance shoe removal and replacement.

10 Claims, 8 Drawing Figures

10
12
14
16
18
20
22
24
26
28
30
32
34
36
38
40
42
44
46
48
50
52
54
56
58
60
62
64
66
68
70
72
76
78
80
86
88
94

10
12
26
28
32
46
38
72
34
68
44
46
60
18
88
60
30
30
76
80
78
78
90
66
94
92
94
70
70
64
40
42
66
62
60
86
48
28
24
32
46
64
36
34
68
72
46

10
12
26
28
96
32
46
96
38
64
34
44
68
96
46
18
88
60
60
30
30
76
80
78
78
66
92
94
94
70
72
42
62
90
40
66
60
86
48
28
96
24
32
46
96
36
64
34
68
46
96
60

TILT WINDOW BALANCE SHOE ASSEMBLY

BACKGROUND OF THE INVENTION

The so-called tilt window, being characterized by having window sash structures and hardware which enable pivotal sash movement out of the supporting frame structure plane from a vertically closed position to an angularly disposed inward position and then angularly disposed vertical adjustment and pivotal horizontal locking thereof at a selected vertical position with the sash disposed on an axis normal to the support frame for purposes of cleaning, maintenance, ventillation, or otherwise, are well developed and relatively old in the art wherein representative teachings of both the tilt window structure and pivotal sash lock hardware therefor are generally as set forth in U.S. Pat. No. 616,484 to Myers dated Dec. 27, 1898, U.S. Pat. No. 3,184,784 to Peters dated May 25, 1965, and U.S. Pat. No. 3,434,236 to Weidner et al dated Mar. 25, 1969. In all of the foregoing teachings it will be noted that the sash lock structure for a tilt window assembly operates on a pivotal cam shaft fixed to the sash frame and insertably engaged pivotally within a lobed opening in the sliding shoe member which is positioned to vertically slide along therewith within the window casing channel, so that upon pivotal deflection of the sash frame the cam shaft thereupon engages the lobed opening to thereby drive sash channel friction engagement elements into fixed contact with the sash channel and lock the adjustably displaced sash into a secured position.

As with all mechanical hardware components, due to breakage or wear, it at one time or another becomes necessary to replace or repair the same. Heretofore, in the replacement or repair of conventional unitarily constructed tilt window balance shoe hardware, absent a specially cut access notch in the Window casing jamb during production prefabrication procedures to later enable facilitated removal of a broken or worn balance shoe, it becomes necessary to remove and later reinstall the window sash counterbalance mechanism in order to remove and replace, or have reasonable access to repair, the balance shoe hardware.

The present invention relates to a vertically operable tilt window balance shoe assembly, and more particularly to a split tilt window balance shoe structure suitable as either original or replacement hardware being adapted for the replaceable installation and removal thereof within a window casing sash channel thereby eliminating the prefabricating cost of providing a specially cut window jamb notch to accommodate the after-installation removal of a worn and reinstallation of a replacement tilt window balance shoe, or if no such access notch has been provided then elimination of both the cost and inconvenience of additionally removing and reinstalling the window sash counterbalance mechanism in order to accomplish balance shoe replacement.

The instant invention overcomes many of the fabricating, maintenance, and repair problems and attendant cost factors as relates to conventional tilt window balance shoe employment, and although some of the elements of the present invention have been disclosed in the art there is no description determined therein of that split shoe construction and cooperative combination of elements resulting in the present structures and utility and economy features of novel merit as set forth hereinafter.

SUMMARY OF THE INVENTION

It is the principal object of the present invention to provide a tilt window balance shoe assembly adapted for insertable installation within, and removable disassembly from, a window casing sash channel without the requirement of providing a specially cut window jamb access notch, or, in the absence thereof, the necessity of removing and replacing the window sash counterbalance mechanism.

It is another object of the present invention to provide a tilt window balance shoe assembly which may be utilized and installed as original hardware, or later installed as replacement hardware.

It is a further object of the present invention to provide a tilt window balance shoe assembly which when utilized and installed as original hardware enables an enhanced installed window appearance in that the otherwise obvious and detracting window jamb access notch normally provided in modern window case production procedures when conventional unitarily constructed balance shoe hardware is utilized is eliminated.

Still another object of the present invention is to provide a tilt window balance shoe assembly which when utilized as either original hardware, or replacement hardware, enables the realization of a substantial reduction in both production and maintenance costs by significant reductions in both manufacturing operations and time as well as also maintenance and repair operations and time.

It is yet another object of the present invention to provide a tilt window balance shoe assembly which embodies a modular construction, thereby enabling the replacement of worn or broken parts as required rather than necessitating the replacement of the entire assembly as is the case with currently available conventional balance shoe hardware assemblies.

It is also an object of the present invention to provide a tilt window balance shoe assembly which is inherently simple, mechanically reliable, and readily adaptable to efficient and low cost mass production manufacturing techniques.

DETAILED DESCRIPTION OF THE INVENTION

Figures 1, 2:
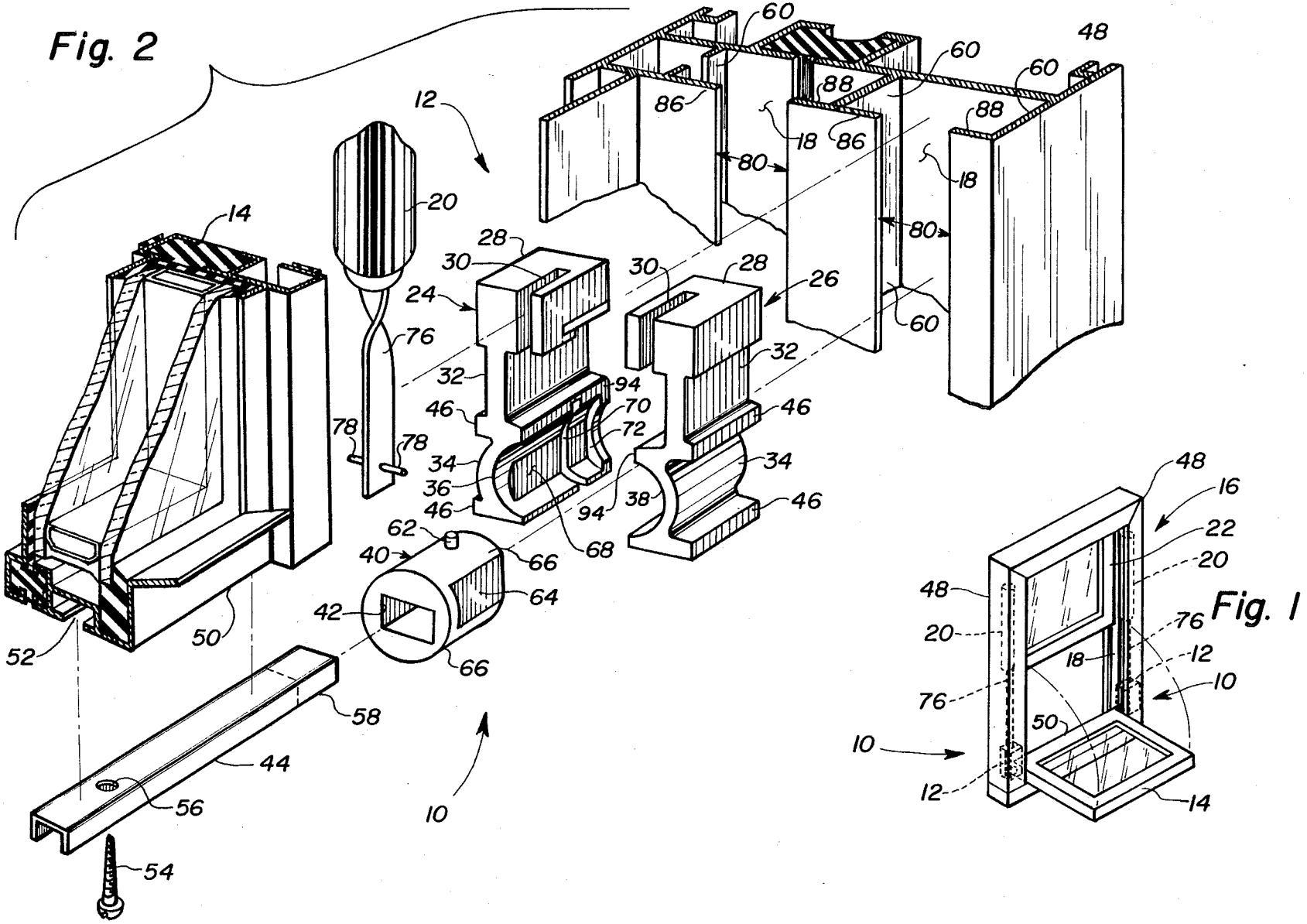
FIG. 1 is a frontal perspective elevation view of an exemplary double hung tilt window employing balance shoe assembly hardware embodying the present invention, therein illustrating the upper sash thereof in a closed position and the lower sash thereof in the alternate pivotally tilted open and locked position.
FIG. 2 is an exploded perspective view of the tilt window balance shoe assembly of the present invention showing also therein the relative relationships thereof with the window casing jamb channel, the sash frame counterbalance mechanism, window sash frame and sash frame-to-balance shoe pivot bar connector.

Referring to FIG. 1, a set of tilt window balance shoe assemblies 10 embodying the split balance shoe structure 12 of instant invention, is shown installed in operational configuration upon the lower window sash 14 within an exemplary double hung tilt window 16 wherein said lower window sash 14 is illustrated in the pivotally tilted open and cam-locked position and further wherein the respective balance shoe assemblies 10 are cammed to the extended friction engagement disposition within the window casing jamb channel 18 in retention of said sash 14 in an adjustably set fixed elevation position against the retractive force of the counterbalance mechanism 20. For purposes of illustrative clarity only, only the lower window sash 14 tilt window balance shoe assemblies 10 and the cooperative hardware components therefor are shown, wherein, however, it is to be understood that the upper window sash 22 would also be similarly equipped with a set of tilt window balance shoe assemblies 10 likewise embodying the split balance shoe structure 12 of instant invention and that the detailed description of structure, installation, and operation hereinafter rendered for the lower window sash cooperative hardware components applies equally to the upper window sash cooperative hardware components and operation.

Referring now to FIG. 2 to describe in greater detail the component parts of this invention as well as explain the structural and cooperative features thereof, wherein it will be noted that the tilt window balance shoe assembly 10 having a split balance shoe structure 12 is comprised of a first balance shoe half 24 and a second balance shoe half 26 wherein said balance shoe halves 24 and 26 are substantially mirror images of each other and when joined in aligned combined assembled communication form the tilt window balance shoe assembly 10 housing per se which provides an upward disposed jamb channel guide block 28 having integrally formed counterbalance mechanism T-bar connection and retention slots 30, and downwardly projecting from said jamb channel guide block 28 a dual cam housing support web member 32 integrally connecting dependently therefrom the inwardly disposed cam housing flexure sleeve 34 formed by the registrable abuttment of the first and second semicircular faces 36 and 38 of said first balance shoe half 24 and said second balance shoe half 26 to take the circular opening describing said cam housing flexure sleeve 34 which slidably and supportably receives the balance shoe barrel cam 40 that acceptably communicates by means of pivot bar opening 42 with the tilt window sash 14 insertably engaged pivot bar 44 so that upon pivotal tilting of said window sash 14 there is a transmittal of rotational operation through said insertably engaged pivot bar 44 to said balance shoe barrel cam 40 whereby is effected expansion and retraction of said cam housing flexure sleeve 34 which is transmitted to said balance shoe halves 24 and 26 thereby to engage with or release from frictional contact with the window casing jamb channel 18 the outwardly projecting jamb channel friction flexure locking lugs 46. Although not described in particularity at this point, it should be emphasized at this point that it is the split balance shoe structure 12 of said tilt window balance shoe assembly 10 of instant invention which enables the installation assembly and disassembly removal thereof from a window casing jamb channel without the providing of a window jamb balance shoe access and removal notch, or in the absence thereof, the necessity of removing and replacing the counterbalance mechanism, all of which will be more fully detailed and described on a subsequent consideration of FIGS. 3 through 6 hereinafter.

Referring again to FIG. 2 to further explain the cooperative mechanical and structural features of said tilt window balance shoe assembly 10 with the remaining window assembly components, wherein it is to be understood that the window casing frame 48 containing the jamb channel 18, along with the tilt window sash 14, counterbalance mechanism 20, and pivot bar 44 are representative of structures well known and typical in the art and are to be considered as exemplary only of those type window assembly components and auxiliary hardware with which said balance shoe assembly 10 may be beneficially employed. In the foregoing respect, it will be noted that the pivot bar 44 which insertably communicates with the balance shoe barrel cam 40 by engagement within the pivot bar opening 42 at one end thereof at the other end thereof is affixed by suitable means to the lower side of the lower frame memher 50 of the tilt window sash 14, in this case by means of insertable aligned retention of said pivot bar 44 within a lower frame slot 52 being secured therein by threadable engagement of the pivot bar retention screw 54 with said lower frame member 50 cooperatively through the pivot bar retention screw opening 56. As also shown in FIG. 2, the longitudinal affixment alignment of said pivot bar 44 with the lower frame slot 52 is such as to provide for a laterally outward projecting pivot bar segment 58 which is that portion of said pivot bar 44 insertably engaged within the pivot bar opening 42 of the balance shoe barrel cam 40 whereby a transmittal of pivotal displacement of said tilt window sash 14 in the tiltable opening or closing thereof is mechanically communicated as a corresponding rotational motion to said barrel cam 40 in effecting lockable engagement or disengagement of said balance shoe assembly 10 by means of a cammed expansion or retraction of said split balance shoe structure 12 thereof and frictional contact or contact withdrawal of the jamb channel friction flexure lock lugs 46 cooperatively with lock lug engagement surfaces 60 of the window casing jamb channel 18.

It will be noted, as shown in FIG. 2, that the barrel cam 40 is provided with a cam housing flexure sleeve retention lug 62 which functions as the split balance shoe structure 12 assembly and disassembly key, as will hereinafter be more fully described. Said barrel cam 40 is also provided with a set of barrel cam flats 64 and normal thereto a set of barrel cam rounds 66, whereby cammable extension and retraction of said split balance shoe structure 12 within the window casing jamb channel 18 upon pivotal displacement of the tilt window sash 14 and a corresponding rotational translation thereof through insertable engagement of pivot bar 44 with said barrel cam 40 as previously described is accomplished through a rotational displacement engagement of the barrel cam rounds 66 with the flexure sleeve cam flats 68 to thereby effect a cammable extension outward of the first and second balance shoe halves 24 and 26 within said window casing jamb channel 18 to thus cause a frictional engagement of the jamb channel friction flexure lock lugs 46 with the lock lug engagement surfaces 60 to lockably fix said tilt window sash 14 at a vertically displaced tilt-opened position as illustrated by the lower tilt window sash 14 in FIG. 1, and upon a tilt-closing of said sash effect a corresponding 90-degree translated rotational displacement of said barrel cam 40 to bring the normally positioned cam flats 64 thereof into aligned coincidence with the cam flats 68 of said cam housing flexure sleeve and thus cammably release the outward extension force on said first and second balance shoe halves 24 and 26 to in turn effect a frictional contact disengagement of the jamb channel friction flexure lock lugs 46 from the lock lug engagement surfaces 60 and release the tilt window sash for resumed vertical displacement movement or closure as illustrated by the upper tilt window sash 22 also in FIG. 1.

Additional structural features of the tilt window balance shoe assembly 10 shown in FIG. 2 include the retention lug assembly and guide slot 70 which receives the cam housing flexure sleeve retention lug 62 in assembly and disassembly of said assembly 10 and the functional operation thereof, and the barrel cam stop lip 72 which serves as a registration reference and retention means for the balance shoe barrel cam 40 so that the cam housing flexure sleeve retention lug 62 thereof will align with and retainably engage for rotational displacement within the guide slot 70 of said balance shoe assembly 10.

Further shown in FIG. 2 is the counterbalance mechanism connecting rod 76 and the counterbalance mechanism T-bar attachment lugs 78 thereof whereby the counterbalance mechanism 20 is connectably assembled within and retainably engaged by the balance shoe assembly 10 T-bar connection and retention slots 30 when said assembly 10 is installed in operational configuration.

Preferably, the tilt window balance shoe assembly 10 of instant invention, and particularly the first and second balance shoe halves 24 and 26 thereof, are made from suitable high-density self-lubricating and flex-resilient plastic material, however, any suitable natural or synthetic, or metals or alloys thereof, or combinations of any such foregoing materials exhibiting the recited characteristics may be employed.

Figures 3, 4, 5, 6:
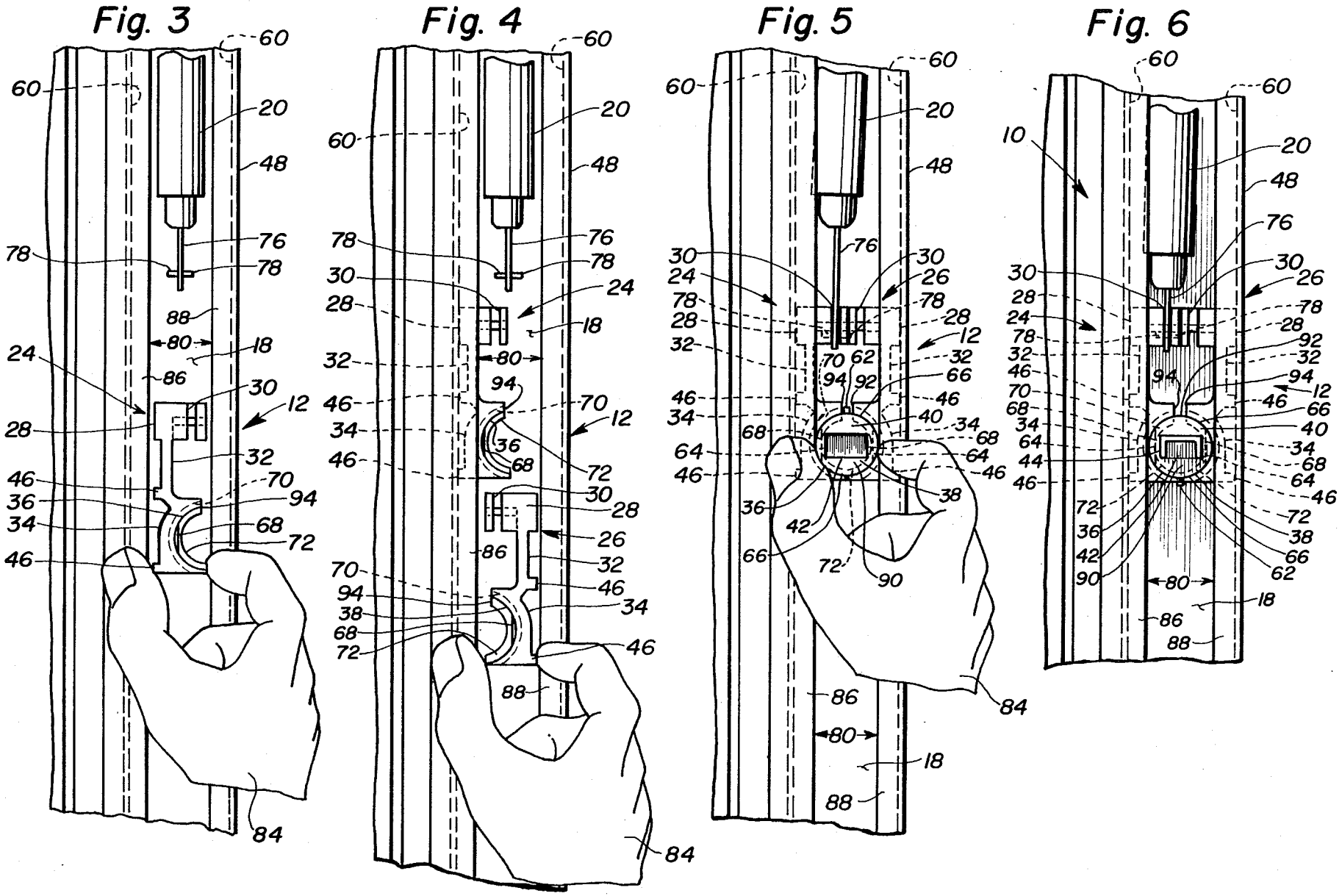
FIG. 3 enlarged fragmentary side elevation view of the window frame counterbalance mechanism and the window casing jamb channel illustrating the insertable replacement positioning therein of the first of the split balance shoe components of the present invention.
FIG. 4 is a view similar to that shown in FIG. 3, further illustrating therein the insertable replacement positioning within the window casing jamb channel of the second of the split balance shoe components of the present invention.
FIG. 5 is a view similar to that shown in FIGS. 3 and 4, herein, however, illustrating connection of the assembled balance shoe structure of the present invention within the window casing jamb channel and connectable assembly thereof to the counterbalance mechanism connector.
FIG. 6 is a view similar to that previously shown in FIGS. 3 through 5, additionally illustrating, however, the completed operational replacement installation of the tilt window balance shoe assembly embodying the split balance shoe structure of the present invention.

Referring now to the FIG. 3 through FIG. 6 series of illustrations, which shows the step wise progressive assembly procedure employed for installing a tilt window balance shoe assembly 10 of instant invention, embodying the split balance shoe structure 12 feature, within an exemplary window casing jamb channel 18. As shown in FIG. 3, a typical segment of window casing frame 48 is illustrated with the window casing jamb channel 18 and counterbalance mechanism 20 in typical spatial relationships as would normally appear for receiving either a original balance shoe assembly 10 installation, or a replacement balance shoe assembly 10 installation, wherein the progressive installment procedure therefor, in either case, is the same. Since the balance shoe assembly 10 is provided with a split structure 12 respectively comprised of the first and second balance shoe halves 24 and 26, and since the window casing jamb channel 18 access opening 80 is typically of a sufficient width to physically admit separate insertable passage respectively of said first and second balance shoe halves 24 and 26 for subsequent manipulative assembly positioning and cooperative alignment thereof within said window casing jamb channel 18, such a progressive installment technique is both enabled and employed. Specifically, FIG. 3 shows the positioning and hand 84 held and controlled insertable passage of the first balance shoe half 24 through the window casing jamb channel access opening 80 for installation assembly placement and retention thereof behind the window casing jamb channel access opening lip 86, which is as shown in FIG. 4, being the first step of the balance shoe assembly 10 installment assembly procedure. Secondly, the operator by a similar hand 84 held and controlled insertable passage technique admits the second balance shoe half 26 through said window casing jamb channel access opening 80 and likewise hand 84 manipulates the same into an installation assembly placement and retention thereof behind the opposing window casing jamb channel access opening lip 88 and thereupon brings the same into a cooperative abuttable assembly alignment with said first balance shoe half 24, which is as shown in FIG. 5.

When the respective balance shoe halves 24 and 26 are manipulatively aligned as illustrated in FIG. 5, the same are thereupon readied for receivable assembly therewith of the balance shoe barrel cam 40 by aligned slidable insertion thereof into the cam housing flexure sleeve opening 90 formed by the abuttable alignment of the first and second semicircular faces 36 and 38, wherein said barrel cam 40 is oriented so that the respective barrel cam flats 64 are positioned in parallel contiguous alignment with the respective flexure sleeve cam flats 68 as shown and the cam housing flexure sleeve retention lug 62 is thereupon aligned for insertable passage within the retention lug channel 92 formed by coincidental abuttable alignment of the cam housing semicircular face recessed upper lips 94. The barrel cam 40, positioned as above-described, is then insertably pressed by hand 84 pressure into the cam housing flexure sleeve opening 90 to the point of contact of the back face thereof with the barrel cam stop lip 72 at which point the cam housing flexure sleeve retention lug 62 of said barrel cam 40 is positioned for rotatably displaced passage within the retention lug assembly and guide slot 70, and when the foregoing rotatable passage is effected by hand 84 rotatable manipulation of said barrel cam 40 the flexure sleeve retention lug 62 thereof then functions as a key to lock the tilt window balance shoe assembly 10 together as a unitary hardware fixture as shown in FIG. 6 within the window casing jamb channel 18. Next, the counterbalance mechanism connecting rod 76 is hand 84 manipulated so that said connecting rod 76 passes within the T-bar connection slot 30 and the T-bar attachment lugs 78 are retainably engaged by the retention slots provided within the jamb channel guide block 28 as shown so that the tilt window balance shoe assembly 10 thus connected operates against the counterbalance mechanism 20 retractive force cooperatively with the tilt window sash operably connected in the foregoing assemblage of functional components by means of the barrel cam-to-sash frame intercommunicating pivot bar 44 as previously described and as shown in FIG. 6, wherein it will be noted that the barrel cam 40 has been rotated within the cam housing flexure sleeve opening 90 so that the retention lug 62 thereof is retainably held within the retention lug assembly and guide slot 70 with the barrel cam disposed within said flexure sleeve opening 90 in the cooperative cam flat 64-flexure sleeve flat 68 facing neutral friction flexure lock lug 46 disengaged configuration prior to connectable assembly of the pivot bar 44 to the lower sash frame member, which illustrates the completed operational procedure for installation of said tilt window balance shoe assembly 10 within a window casing jamb channel 18 without the prior provision of a jamb channel access notch or in the absence thereof the necessity for removing and replacing the counterbalance mechanism.

The disassembly procedure for removal of said tilt window balance shoe assembly 10 for purposes of repair or replacement is simply the reverse of that step wise procedure just described in detail in consideration of FIGS. 3 through 6, and for purposes of brevity is not herein re-described except to say the disassembly procedure for removal of said tilt window balance shoe assembly 10 is that as shown in the sequence of steps illustrated in going from FIG. 6 through FIG. 3. It is also to be re-emphasized at this point, as had been stated in the foregoing, there are two such balance shoe assemblies 10 employed in a tilt window sash installation as shown and previously described on earlier consideration of FIG. 1 wherein both the assembly and disassembly steps and procedure for each of said such assemblies 10 are the same as just above described.

Figure 8:
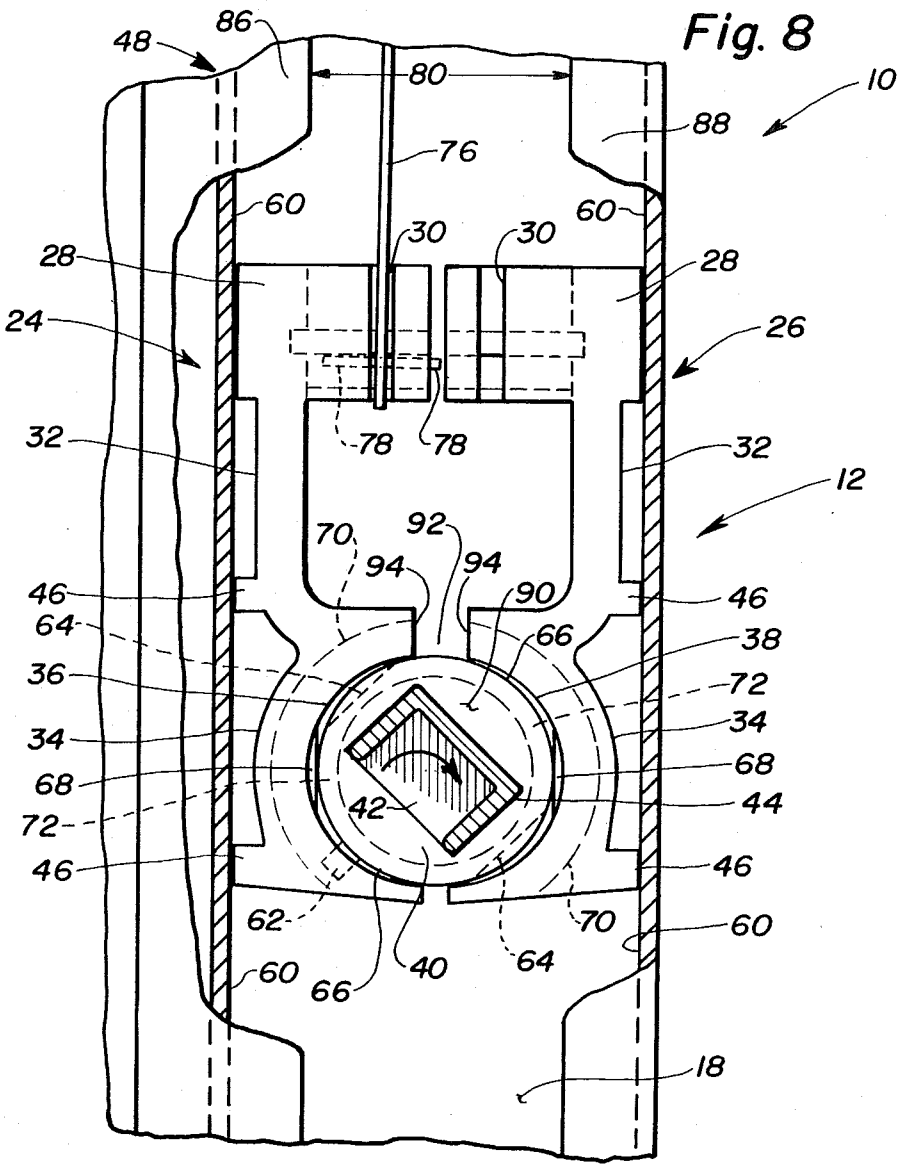
FIG. 8 is an enlarged side elevation view of the tilt window balance shoe assembly similar to that as shown in FIG. 7, however, herein being illustrated in the camlock engaged configuration.
Figure 7:
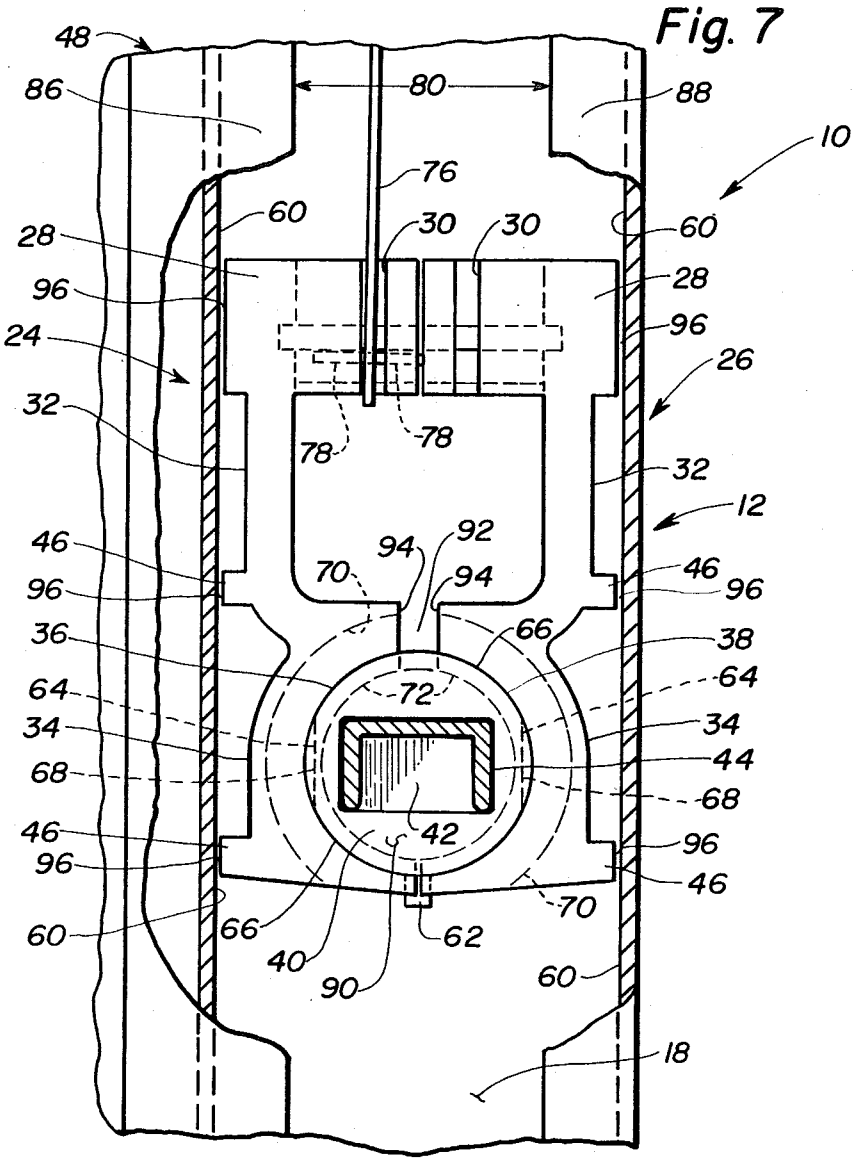
FIG. 7 is an enlarged side elevation view of the tilt window balance shoe assembly showing the same in the neutral guide-only configuration.

Considering lastly the illustrations shown in FIGS. 7 and 8, being further enlarged side elevations of the tilt window balance shoe assembly 10 wherein FIG. 7 is similar to that view as previously shown in FIG. 6 with said assembly 10 being disposed in a barrel cam 40 neutral position and FIG. 8 is a view showing said assembly 10 with the barrel cam 40 rotated to an operational position, these last views being provided to more clearly illustrate the split balance shoe 12 jamb channel guide block 12 and jamb channel friction flexure lock lug 46 relationships to the window casing jamb channel 18 in both the balance shoe barrel cam 40 neutral and operational configurations.

As illustrated in FIG. 7, representing when the window sash is disposed in a closed vertical position as, for example, that shown by the upper tilt window sash 22 in FIG. 1, by means of the sash-to-barrel cam intercommunicating pivot bar 44, the barrel cam 40 is rotationally disposed so the respective barrel cam flats 64 are aligned within the cam housing flexure sleeve opening 90 to align in parallel contiguous coincidence with the flexure sleeve cam flats 68 so that there is no exertion of outwardly directed expansive force per se on the respective first and second balance shoe halves 24 and 26 and the balance shoe assembly 10 is disposed within the window casing jamb channel 18 with close but moveable clearance tolerance 96 between the faces of the jamb channel guide block 28, the jamb channel friction flexure lock lugs 46, and the jamb channel 18 lock lug engagement surfaces 60. The foregoing clearance tolerance 96 is sufficient to allow free movement of said balance shoe assembly 10 within the enclosement confines of said window casing jamb channel 18, but close enough to provide aligned and non binding guidance of said balance shoe assembly 10 within said window casing jamb channel 18 upon movement thereof during a non-tilt vertical displacement adjustment of said sash.

Next, as illustrated in FIG. 8, representing when the window sash is disposed in a tilt position as, for example, generally in that manner shown by the lower tilt window sash 14 in FIG. 1, again by means of the sash-to-barrel cam intercommunicating pivot bar 44, the barrel cam 40 is rotationally disposed so the respective barrel cam flats 64 are moved out of alignment with the flexure sleeve cam flats 68 and the barrel cam rounds 66 are rotationally moved into cammable expansive contact therewith so the respective first and second balance shoe halves 24 and 26 are caused to move laterally within the containing confines of the window casing jamb channel to effect an outwardly directed expansive force and in turn cause a compressive contact lockable engagement between the jamb channel friction flexure lock lugs 46 and the lock lug engagement surfaces 60 of said window casing jamb channel 18, thus fixing said balance shoe assembly 10 and said sash at a vertically adjusted tilt disposition within the window casing frame 48.

It is to be noted that at an intermediate barrel cam 40 rotational displacement, being an arcuate movement thereof between that as respectively illustrated in FIG. 7 and FIG. 8, the relative positions of the respective flats 64 and 68 are such as to enable a tilting of the sash with an intermediate cammable displacement of said friction flexure lock lugs 46 which further closes the close but moveable clearance tolerance 96 but does not effect a sufficient displacement of said lock lugs 46 to cause a fixed compressive contact engagement thereof with the lock lug engagement surfaces 60 of the window casing jamb channel 18, thereby enabling a vertically displaced adjustable movement of said sash when tiltably disposed at an intermediate setting as described.

Although the tilt window balance shoe invention hereof, and the methods of employment and use thereof, respectively have been herein shown and described in what are conceived to be the most practical and preferred embodiments, it is recognized that departures may be made respectively therefrom within the scope of the invention, which is not to be limited per se to those specific details as disclosed herein but is to be accorded the full scope of the claims so as to embrace any and all equivalent devices, apparatus, and methods.

I claim:

1. A tilt window balance shoe assembly, including:

a split balance shoe structure comprises of a first balance shoe half and a second balance shoe half adapted for mechanically cooperative insertable assembly within a window casing jamb channel, a barrel cam, first and second semicircular faces provided respectively in said first and second balance shoe halves adapted upon insertable window casing jamb channel assembly thereof to form a flexure sleeve opening with an elongated slot to insertably receive a barrel cam provided with a flexure sleeve opening retention lug protrusion and for rotatably retained receivable support thereof including a retention lug assembly and guide slot to retain said retention lug protrusion upon rotational deflection of said barrel cam, and a pivot bar means cooperatively communicating with said barrel cam interconnectably with the lower frame member of a tilt window sash and operable therewith to translate pivotal sash displacement therethrough for effecting rotation of said barrel cam within said flexure sleeve opening and thereby move said first and second balance shoe halves and cause a friction contact locking or release of said balance show assembly within said window casing jamb channel.

2. The tilt window balance shoe assembly according to claim 1 in which said first and said second semicircular faces of said first and said second balance shoe halves are each provided with a barrel cam stop lip operable to limit the insertable travel of said barrel cam and effect alignment of said retention lug with said retention lug assembly and guide slot for rotatably retained receivable support of said barrel cam.

3. The tilt window balance shoe assembly according to claim 2 in which said retention lug assembly and guide slot is adapted to receivably retain and guide rotationally said retention lug of said barrel cam upon arcuate displacement thereof to lockably key together cooperatively said balance shoe halves of said balance shoe assembly operationally within said window casing jamb channel.

4. The tilt window balance shoe assembly according to claim 3 in which said first and said second semicircular faces are provided respectively with cam flats operable to effect extension and retraction of said first and second balance shoe halves upon rotation of said barrel cam.

5. The tilt window balance show assembly according to claim 4 in which said barrel cam is provided with a set of opposingly faced cam flats and a set of opposingly faced cam rounds.

6. The tilt window balance shoe assembly according to claim 5 in which said barrel cam is provided with an opening geometrically configured to retainably receive an outwardly projecting segment of said pivot bar.

7. The tilt wondow balance shoe assembly according to claim 6 in which said first and second balance shoe halves further include a jamb channel guide block cooperatively formed by a set of upward projecting guide block members supportably intercommunicating unitarily respectively with said first and second semicircular faces by means of web members.

8. The tilt window balance shoe assembly according to claim 7 in which said balance show halves are respectively provided with a spaced set of outward projecting jamb channel friction flexure lock lugs cooperatively operable to compressively engage or release from compressive engagement with the jamb channel lock lug engagement surfaces upon operational rotation of said barrel cam.

9. The tilt window balance shoe assembly according to claim 8 in which said upward projecting guide block members are respectively provided with a counterbalance mechanism T-bar connection and retention slot.

10. A method for installably assembling a tilt window balance shoe cooperatively with a tilt window sash and counterbalance mechanism therefor within a window casing jamb channel comprising the sequential steps of:

inserting and hand manipulating a first balance shoe half into a vertically disposed assembly position within said window casing jamb channel, inserting and hand manipulating a second balance shoe half cooperatively with said first balance shoe half into said vertically disposed assembly position within said window casing jamb channel, inserting and hand rotatably engaging a barrel cam provided with a cam housing flexure sleeve retention lug respectively within a flexure sleeve opening and a retention lug assembly and guide slot formed by the manipulatively installed assembly of said first and second balance shoe halves to thereby form an assembled tilt window balance shoe, and cooperatively connecting said assembled tilt window balance shoe by affixing the lower vertical end thereof by pivot bar means to a lower frame member of said tilt window sash and the opposite vertical end thereof to said tilt window counterbalance mechanism.

* * * * *